United States Patent [19]

Wheeler

[11] Patent Number: 4,803,825

[45] Date of Patent: Feb. 14, 1989

[54] BEAM CHAIR

[76] Inventor: Charles F. Wheeler, 6141 NW. 34th Way, Fort Lauderdale, Fla. 33309-2221

[21] Appl. No.: 126,613

[22] Filed: Nov. 30, 1987

[51] Int. Cl.[4] ..... E04C 5/16

[52] U.S. Cl. ..... 52/677; 52/687; 52/689; 249/30; 249/217; 249/219.1

[58] Field of Search ..... 52/295, 432, 442, 677, 52/678, 687–689, 699, 712, 719, 251, 252, 684–686, 743; 249/30, 86, 91, 207, 216–218, 219 R

[56] References Cited

U.S. PATENT DOCUMENTS

| | | | |
|---|---|---|---|
| 1,151,378 | 8/1915 | Neevel | 52/685 |
| 1,214,790 | 2/1917 | Hough | 52/684 |
| 1,245,632 | 11/1917 | Straub | 52/678 |
| 1,247,554 | 11/1917 | Lockwood | 52/678 |
| 1,260,494 | 3/1918 | Widmer | 52/689 |
| 1,263,776 | 4/1918 | Lampert | 52/684 |
| 1,287,052 | 12/1918 | Lampert | 52/684 |
| 1,523,628 | 1/1925 | Baker | 52/685 |
| 1,921,538 | 8/1933 | Priest | 52/685 |
| 2,260,973 | 10/1941 | Healey et al. . | |
| 2,260,974 | 10/1941 | Healey et al. . | |
| 2,409,342 | 10/1946 | Cassidy . | |
| 3,105,423 | 10/1963 | Reiland . | |
| 3,325,959 | 6/1967 | Torp | 52/689 |
| 3,430,407 | 3/1969 | Berry | 52/689 |
| 3,471,987 | 10/1969 | Yelsma . | |
| 3,736,719 | 5/1973 | Wise . | |

FOREIGN PATENT DOCUMENTS

| | | | |
|---|---|---|---|
| 2313509 | 12/1973 | Fed. Rep. of Germany | 52/686 |
| 2636458 | 2/1978 | Fed. Rep. of Germany | 52/677 |

*Primary Examiner*—David A. Scherbel
*Assistant Examiner*—Richard E. Chilcot, Jr.
*Attorney, Agent, or Firm*—Karen M. Gerken; Martin P. Hoffman; Mitchell B. Wasson

[57] ABSTRACT

A beam chair for supporting, positioning and retaining a reinforcement bar is a concrete structural member and, in particular, in a concrete structural member such as a beam or slab. The beam chair is defined by a horizontal support surface which, together with first and second vertical support members, define an open cavity for receiving a longitudinally oriented reinforcing bar and wherein the bar is adapted to be supported by the horizontal support surface. The second vertical support member is provided with an upper side extension having a remote edge. The first and second vertical support members are provided, respectively, with first and second depending members which terminate in lower edges. A lower side extension projects from the second depending member parallel to the upper side extension. The beam chair is adapted to be placed within a form for the structural member by resting the lower edges and the lower side extension upon the bottom surface established for the form, and by placing the outer edge of the upper side extension against the side of the form. A plurality of beam chairs are adapted to be so arranged within the form, whereby they support upon their respective horizontal support surfaces at longitudinally spaced locations a reinforcing bar. The beam chair is adapted to accept a range of different sized reinforcing bars, and is particularly configured to locate the reinforcing bars the requiste distance inside the face of the concrete at the sides and bottom of the structural member.

14 Claims, 1 Drawing Sheet

BEAM CHAIR

CROSS REFERENCE TO RELATED PATENT APPLICATIONS

The subject matter of the invention herein disclosed and described is related to applicant's co-pending patent application Ser. No. 017,500, filed Feb. 24, 1987 and being directed to a steel placement member, and co-pending patent application Ser. No. 009,785, filed Feb. 2, 1987 now U.S. Pat. No. 4,748,785 and being directed to a support member for reinforcing steel.

CROSS REFERENCE TO RELATED PATENTS

The subject matter of the invention herein disclosed and described is related to applicant's U.S. Pat. No. 4,644,726, which issued on Feb. 24, 1987 on application Ser. No. 835,292, filed Mar. 3, 1986 and being directed to a steel placement assembly.

BACKGROUND OF THE INVENTION

1. Field of the Invention

The invention broadly pertains to a means for supporting and locating reinforcing steel in a concrete structural member. More particularly, the invention is directed to a beam chair particularly adapted to positively support and position a reinforcing steel bar in reinforced concrete beams and slabs. The beam chair is specifically adapted to accept a range of different sized reinforcing bars, and is particularly suited for locating the reinforcing bars the requisite distance inside the face of the concrete. When retained by means of the beam chair, the reinforcing bars are positively restrained against the undesirable axial and rotational movement which is apt to occur during placement of the concrete when utilizing conventional devices.

A critical element of reinforced concrete design involves the accurate placement and support of the reinforcing steel bars in the concrete structural member. It is essential that the reinforcing steel be precisely located and supported the required distance inside the face of the concrete. Failure to maintain the reinforcing steel a sufficient distance, generally 1½ inches, inward of the face of the concrete results in detrimental oxidation of the steel reinforcement, thereby significantly compromising the integrity of the structural member and necessitating costly and extensive restoration of the structure. The support member of the instant invention addresses and eradicates the normally prevalent problem of oxidation associated with reinforced concrete members by insuring accurate location of the steel reinforcement the optimum distance inside the face of the concrete.

The detrimental effects of oxidation can only be entirely prevented when the reinforcing steel is not only accurately positioned inside the concrete face, but when the reinforcing steel is also restrained from axial and rotational movement during placement of the concrete, so as to prevent unwanted shifting of the steel from its required position. The spacer member of the present invention is uniquely capable of obtaining effective and consistent placement of the steel the necessary distance inside the face of the concrete.

Moreover, insuring the design integrity of a concrete structural member demands that the reinforcing steel bars be successfully and reliably locked in position within the concrete form to prohibit shifting of the steel when the concrete is placed. The subject support member positively prevents undesirable and potentially damaging movement of the reinforcing steel from design parameters, thereby enhancing the structural integrity of the concrete members. Consequently, the design efficiency of architects and engineers for concrete structural members is enhanced, while the potential liability for the technical designer is substantially reduced. Additionally, the attributes in design and placement of reinforcing steel realized with the present spacer member result in lower costs of construction and maintenance for reinforced concrete structures.

A further significant feature of the invention involves its impressive ease of utilization in the field by relatively unskilled personnel. Prior art methods and devices for locating reinforcing steel in beams and chairs have proved to be unsatisfactory due to the great difficulty, unreliability and complexity associated with their use. Not only do conventional chairs for beams and slabs fail to accurately and securely position the reinforcing bars, but it is also difficult for field personnel to insert the bars into such chairs. Consequently, conventional chairs invariable turn over, rotate or otherwise move out of their correct position when the steel is placed therein, and when the concrete is poured. As a result, the latter devices are problematic for these and many additional reasons, including the excessive time and labor consumed, and the inaccuries in assembly which result in improper positioning of the steel reinforcing bars within the form. The subject invention, in contrast, is not only simple to utilize, but also provides a continually reliable means for assuring precise positioning of the reinforcing steel.

The foregoing features are realized with the instant invention by presenting a spacer member for reinforcing steel bars, which spacer member lends itself for implementation in locating, supporting and retaining steel reinforcing bars the required distance inward of the concrete form and, hence, the outside face of the concrete. The invention is advantageous for its unprecedented reliability, feasibility, simplicity and economy, and is adapted to be formed so as to accommodate a variety of sizes and spacing schemes for the reinforcing steel in accordance with diverse technical specifications.

SUMMARY OF THE INVENTION

The invention is directed to a beam chair for supporting, positioning and restraining steel reinforcing bars in a concrete structural member and, particularly, in a reinforced concrete beam or slab formed by placing concrete in a form. The beam chair is defined by a horizontal support member having a pair of side edges. A first vertical support member extends upwardly from one of the side edges, and a second vertical support member extends upwardly from the other of the side edges. The horizontal support member and the vertical support members together define an open cavity for receiving a reinforcing steel bar. The second vertical support member is provided with an upper side extension which terminates in an outer edge that is adapted to abut the form when the beam chair is disposed therein.

A first depending member extends downwardly from the first vertical support member. A second depending member similarly extends downwardly from the second vertical support member. Each of the depending members terminates in a lower edge. A lower side extension projects outwardly from the second depending member parallel to the upper side extension. The lower edges and the lower side extension are adapted to be supported by the ground or other planar surface established for the bottom of the form when the beam chair is disposed therein.

The beam chair is particularly designed and configured so as to maintain the reinforcing bar disposed in the cavity formed by the horizontal and vertical support members the required distance inside the side faces and above the bottom face of the concrete. Additionally, the beam chair is uniquely adapted to support the reinforcing steel in its proper position within the form so as to prevent axial or rotational movement of the steel while the concrete is being placed. The beam chair is adapted to accept a range of sizes of reinforcing bars, and is simple and reliable to utilize in the field.

DESCRIPTION OF THE PREFERRED EMBODIMENT

Figure 1:
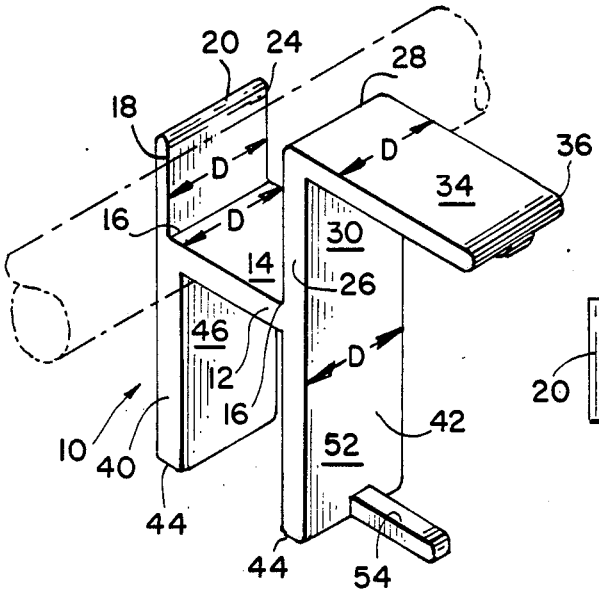
FIG. 1 is a perspective view of the beam chair of the present invention showing in phantom a reinforcing bar being supported thereon.
Figure 2:
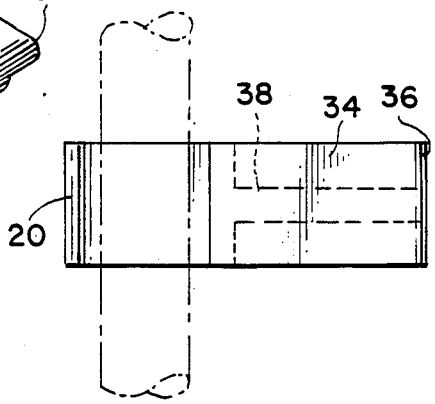
FIG. 2 is a top plan view of the beam chair.
Figure 3:
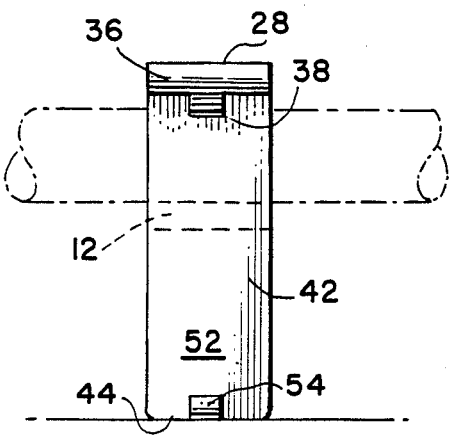
FIG. 3 is a side plan view of the beam chair.

With reference to FIGS. 1–4, the beam chair 10 of the present invention comprises a generally horizontal support member 12 having a planar horizontal supporting surface 14 which terminates in side edges 16. A first generally vertical support member 18 projects perpendicularly upward from one of the side edges of the horizontal supporting surface. The first vertical support member terminates in an upper edge 20, and is further defined by outer surface 22 and inner vertical surface 24. A second generally vertical support member 26 projects perpendicularly upward from the other of the side edges of the horizontal supporting surface. The second vertical support member terminates in an upper edge 28, and is further defined by outer surface 30 and inner vertical surface 32.

Figure 4:
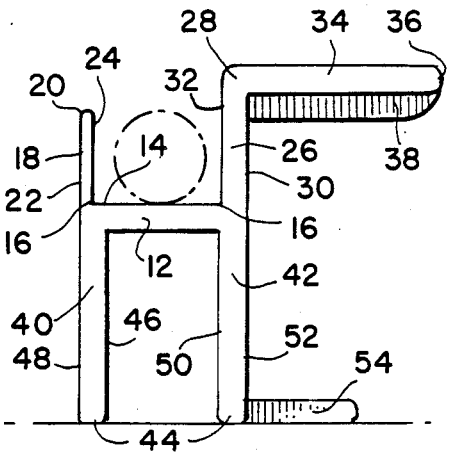
FIG. 4 is a front plan view of the beam chair.

As best seen in FIG. 4, upper edge 28 of the second vertical support member does not extend upwardly to the same height as upper edge 20 of the first vertical support member, but rather, extends upwardly to a height that is slightly greater than that of upper edge 20 of the first vertical support member. Additionally, upper edge 28, unlike upper edge 20, is provided with an upper side extension 34, as most clearly depicted in FIGS. 2 and 4. The upper side extension 34 projects perpendicularly from the upper edge 28 of the second vertical support member in a direction away from the horizontal support member and terminates in an outer edge 36. The upper side extension may be provided with a reinforcing rib or flange 38.

The width of the horizontal support surface 14, as measured between side edges 16, is preferably $1\frac{1}{8}$ inches. The thickness of the first vertical support member, as measured between the outer vertical surface 22 and the inner vertical surface 24 is preferably $\frac{1}{8}$ of an inch. The upper side extension is configured such that the distance between the outer edge 36 and the inner vertical surface 32 of the second vertical support member 26 is preferably $1\frac{7}{8}$inches. The vertical height of the second vertical support member with respect to the horizontal support member, as measured between the upper edge 28 of the second vertical support member and the horizontal support surface, is preferably $1\frac{1}{8}$ inches. As previously noted, the vertical height of the first vertical support member 18 is less than that of the second vertical support member, with the distance between the upper edge 20 of the first vertical support member and horizontal support surface being $\frac{3}{4}$ of an inch.

The first vertical support member is formed with a first integral depending member 40. Similarly, the second vertical support member is formed with a second integral depending member 42. Each of the depending members 40 and 42 terminates in a planar lower edge 44 which is adapted to rest upon the ground or other horizontal surface when the beam chair is placed thereon. The first depending member has an inner surface 46, and an outer surface 48 which is integral and continuous with the outer surface 22 of the first vertical support member. The second depending member has an inner surface 50, and an outer surface 52 which is integral and continuous with the outer surface 30 of the second vertical support member. A lower side extension 54 projects from the outer surface 52 adjacent the lower edge 44, in the same direction as the upper side extension 34 and parallel thereto. The lower side extension 54 is further adapted to rest upon the form or other horizontal surface as shown in FIG. 4.

The first and second depending members 40 and 42 preferably possess a vertical height, as measured from the horizontal support surface 14 to the lower edges 44, of $1\frac{7}{8}$ inches. Thus, the maximum height of the beam chair, measured from the upper edge 28 of the second vertical support member 26 to the lower edge 44 of the second depending member 42, is 3 inches. The thickness of the first and second depending members 40 and 42, as measured between their respective inner and outer surfaces, is preferably $\frac{1}{4}$ of an inch. With reference to FIG. 4, it can be seen that the lower side extension 54 does not project outwardly from the beam chair as far as the upper side extension 34, but rather, projects outwardly less than the upper side extension. With reference to FIG. 1, it is seen that the depth D of the horizontal support member, the vertical support members, the upper side extension and the depending members is, preferably, 1 inch.

The beam chair is intended to be formed as an integral molding of polyethylene.

In operation, the beam chair is utilized by placing a plurality of beam chairs inside a form established for the particular structural member, such that the lower edges and the lower side extensions of the beam chairs are supported by the form or other lower horizontal surface adapted for the base of the form. The beam chairs are adapted to be arranged with respect to each other such that the horizontal supporting surfaces for all of the beam chairs intended to support a particular bar are in alignment. The exact number of and spacing for the beam chairs holding a particular bar will normally be established by the weight of the steel.

The beam chairs are intended to be placed within the form with the outer edges 36 of the upper side extensions 34 abutting the inner surface of the wood form. The reinforcing bar is then placed upon the beam chairs by placing the bar within the open cavity defined by the horizontal support surface and the first and second vertical support members of the beam chairs. The bar will be supported by the horizontal support surface, and positively confined by the first and second vertical support members. Bands may be applied to securely hold the bar against the inner vertical surface of the second vertical support member. The latter arrangement requires that the reinforcing bar be oriented longitudinally with respect to the beam chairs, whereby the reinforcing bar is supported and restrained at longitudinally spaced locations along its length by the aligned beam chairs. When the proper number of bars have been arranged with the form, hoops may be applied to the arrangement of bars.

The particular configuration of the beam chairs insures that the reinforcing bars, as well as any hoop wiring, are maintained a distance of 1½ inches inside the inner walls of the form at the sides and bottom of the structural member and, hence, 1½ inches inside the face of the concrete at the sides and bottom of the beam. The size of the horizontal support surface is adapted to receive a variety of sizes of steel reinforcing bars, ranging in size from #5 to #8 steel reinforcing bars. For slab structural members, the beam chair is intended to be designed to retain the steel reinforcing bars, as well as the hoops, 1½ inches inside the face of the slab at the edges of the slab and ¾ of an inch up from the bottom of the slab.

In addition to maintaining the steel reinforcement the necessary distance inside the face of the concrete so as to overcome the problems associated with oxidation, the beam chair is further uniquely designed to enable simple and efficient assembly within the form. The space formed by the horizontal and vertical support members presents an open and unobstructed cavity into which the steel bars may be dropped. Moreover, the upper side extension, which is adapted to abut the form, in combination with the shorter, lower side extension, which is adapted to rest against the bottom surface established for the form, prevent rotational movement and tipping over of the beam chair when a reinforcing bar is dropped into the beam chair under typical field conditions. Additionally, the beam chair is uniquely suitable for preventing axial and rotational movement of the steel reinforcing bars under stresses imposed during placement of the concrete.

While the invention has been described in connection with a preferred embodiment, it is to be noted that many changes may become apparent to one skilled in the art and that various modifications to the invention may be made without departing from the spirit and scope of the invention as defined by the appended claims.

What is claimed is:

1. A beam chair for supporting, locating and restraining a reinforcing bar in a structural member formed by placing concrete in a form defined by a bottom and sides comprising a horizontal support member having a horizontal support surface and a pair of side edges, a first generally vertical support member extending upwardly from one of said side edges, a second generally vertical support member extending upwardly from the other of said side edges, said second vertical support member having an inner surface, said horizontal support member and said first and second vertical support members together forming an open cavity for receiving said reinforcing bar, an upper side extension extending outwardly from said second vertical support member in a direction away from said horizontal support member, said upper side extension having an outer side edge adapted to abut said sides of said form, a first depending member extending downwardly from said first vertical support member, a second depending member extending downwardly from said second vertical support member, said first and second depending members terminating in a lower edge, a lower side extension extending outwardly from said second depending member in a direction away from said horizontal support member, said upper and lower side extensions being parallel to each other, said lower edges of said first and second depending members and said lower side extension being adapted to rest against said bottom of said form, the horizontal distance from said outer edge of said upper side extension to said inner surface of said second vertical support member being such that said reinforcing bar is adapted to be maintained at least 1½ inches inside said sides of said form, and the vertical distance from said lower edges of said depending members to said horizontal support surface being such that said reinforcing bar is adapted to be maintained at least 1½ inches above said bottom of said form for a beam and at least ¾ of an inch above said bottom of said form for a slab.

2. The beam chair recited in claim 1 wherein the depth of said horizontal support member, said vertical support members, said upper side extension and said depending members is 1 inch.

3. The beam chair recited in claim 1 wherein said lower side extension is shorter than said upper side extension.

4. The beam chair recited in claim 1 wherein said cavity is adapted to accommodate reinforcing bars ranging in size from #5 to #8.

5. The beam chair recited in claim 1 wherein said upper side extension is provided with a reinforcing flange.

6. The beam chair recited in claim 1 wherein said beam chair is formed as an integral molding of polyethylene.

7. A beam chair for supporting, locating and restraining a reinforcing bar in a structural member formed by placing concrete in a form defined by a bottom and sides comprising a horizontal support member having a horizontal support surface and a pair of side edges, a first generally vertical support member extending upwardly from one of said side edges, said first vertical support member being defined by an inner surface, an outer surface and a first upper edge, a second generally vertical support member extending upwardly from the other of said side edges, said second vertical support member being defined by an inner surface, an outer surface and a second upper edge, said second upper edge extending upwardly above said horizontal support surface farther than said first upper edge, said horizontal support member and said first and second vertical support members together forming an open cavity for receiving said reinforcing bar, an upper side extension extending outwardly perpendicularly from said outer surface of said second support member in a direction away from said horizontal support member, said upper side extension terminating in an outer side edge adapted to abut said sides of said form, a first depending member extending downwardly from said first vertical support member and having a first outer surface which is a continuation of said outer surface of said first vertical support member, a second depending member extending downwardly from said second vertical support member and having a second outer surface which is a continuation of said outer surface of said second vertical support member, said first and second depending members terminating in a lower edge, a lower side extension extending outwardly perpendicularly from said second outer surface, said lower edges of said first and second depending members and said lower side extension being adapted to rest against said bottom of said form, said lower side extension extending outwardly from said second outer surface less than said upper side extension extends outwardly from said outer surface of said second vertical support member, the horizontal distance from said outer edge of said upper side extension to said inner surface of said second vertical support member being such that said reinforcing bar, when received in said cavity, is maintained at least around $1\frac{1}{2}$ inches inside said sides of said form, and the vertical distance from said lower edges of said depending members to said horizontal support surface being such that said reinforcing bar is adapted to be maintained at least around $\frac{3}{4}$ of an inch above said bottom of said form.

8. The beam chair recited in claim 7 wherein the depth of said horizontal support member, said vertical support members, said upper side extension and said depending members is 1 inch.

9. The beam chair recited in claim 7 wherein said cavity is adapted to accommodate reinforcing bars ranging in size from #5 to #8.

10. The beam chair recited in claim 7 wherein said upper side extension is provided with a reinforcing flange.

11. The beam chair recited in claim 7 wherein said beam chair is formed as an integral molding of polyethylene.

12. A method of using a beam chair for supporting, positioning and locating a reinforcing bar in a structural member formed by pouring concrete into a form defined by a bottom and sides, said beam chair being characterized by a horizontal support surface having a pair of side edges, a first vertical support member extending upwardly from one of said side edges and a second vertical support surface extending upwardly from the other of said side edges, said horizontal support surface and said vertical support members together defining an open cavity, an upper side extension projecting from said second vertical support member and having an outer edge, a first depending member extending downwardly from said first vertical support member, a second depending member extending downwardly from said second vertical support member, said depending members terminating in lower edges, and a lower side extension projecting from said second depending member parallel to said upper side extension, the method comprising the steps of:

placing a first of a plurality of beam chairs into said form by resting said lower edges and said lower side extension upon said bottom and by causing said outer edge of said upper side extension to abut one of said sides of said form;

similarly placing the remaining of said plurality of said beam chairs into said form, whereby said beam chairs are spaced from each other and with said horizontal support surfaces of said beam chairs being aligned;

placing a reinforcing bar into the cavities presented by said aligned beam chairs, whereby said reinforcing bar is supported upon said horizontal support surfaces of said beam chairs.

13. The method recited in claim 12 further comprising the step of:

securing said reinforcing bar to said second vertical support members.

14. The method recited in claim 12 further comprising the step of:

placing a hoop around said reinforcing bars.

* * * * *